United States Patent [19]

Heinz

[11] 4,216,567

[45] Aug. 12, 1980

[54] FLEXIBLE ORNAMENTAL ARTICLE AND FASTENER THEREFOR

[76] Inventor: Jorg Heinz, Ringstrasse 4, 7530 Pforzheim, Fed. Rep. of Germany

[21] Appl. No.: 695,831

[22] Filed: Jun. 14, 1976

[30] Foreign Application Priority Data

Jun. 14, 1975 [DE] Fed. Rep. of Germany ..... 7519062
Jan. 24, 1976 [DE] Fed. Rep. of Germany ..... 7601893

[51] Int. Cl.[2] ..... A44B 21/00

[52] U.S. Cl. ..... 24/81 J; 24/116 A; 24/221 K; 24/230 TC

[58] Field of Search ..... 24/201 R, 81 J, 221 K, 24/116 A, 230 TC, 73 R; 403/349, 306, 308; 63/3

[56] References Cited

U.S. PATENT DOCUMENTS

| | | | |
|---|---|---|---|
| 1,455,993 | 5/1923 | Conway | 24/230 TC |
| 1,711,848 | 5/1929 | Heitkemper | 24/116 A |
| 1,771,125 | 7/1930 | Kahle | 24/116 A |

FOREIGN PATENT DOCUMENTS

| | | | |
|---|---|---|---|
| 880665 | 7/1949 | Fed. Rep. of Germany | 24/230 TC |

*Primary Examiner*—Kenneth Dorner

[57] ABSTRACT

A fastener for connecting two parts of a flexible ornamental article comprises a sleeve, which is open at both ends and provided with first bayonet joint means adjacent to each end thereof, two plugs, each of which is provided with second bayonet joint means which are contained in said sleeve and interengage with said first bayonet joint means, and a helical compression spring contained in said sleeve between said plugs and urging said plugs axially apart. Each of said plugs is rotatable in said sleeve to disengage said second bayonet joint means of said plug from the first bayonet joint means and is subsequently axially movable out of said sleeve. The fastener can be used to connect two parts of a flexible ornamental article if each of said parts is provided with one of said plugs.

21 Claims, 12 Drawing Figures

Fig.1
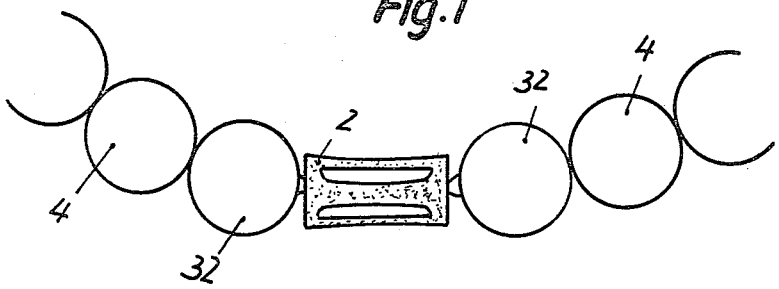
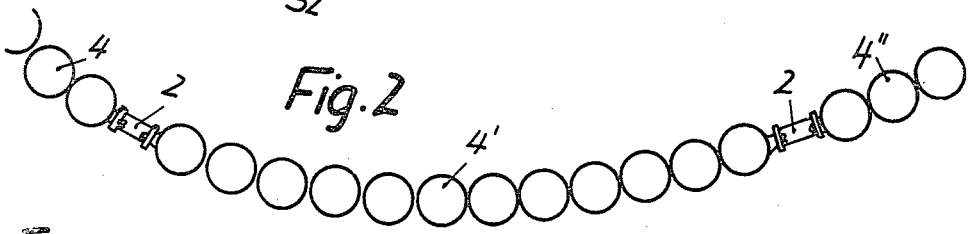
Fig.2
Fig.3
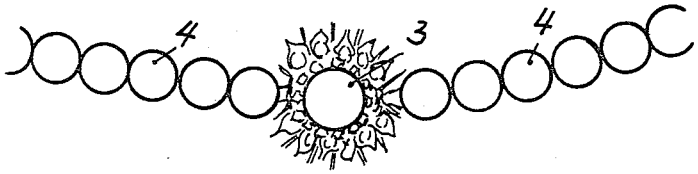
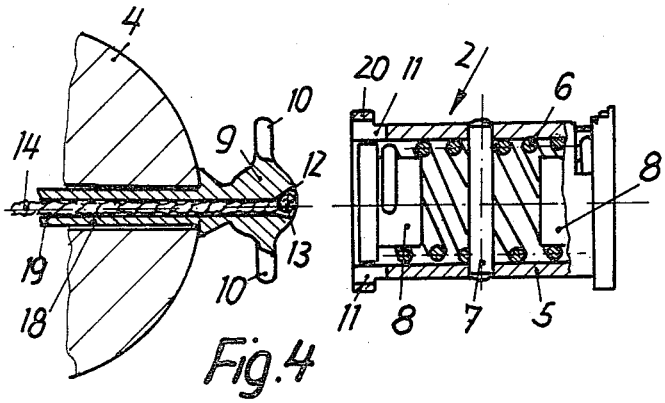
Fig.4
Fig.5
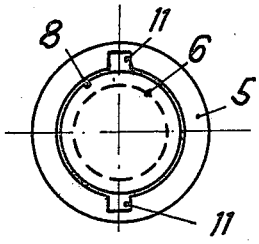
Fig.6
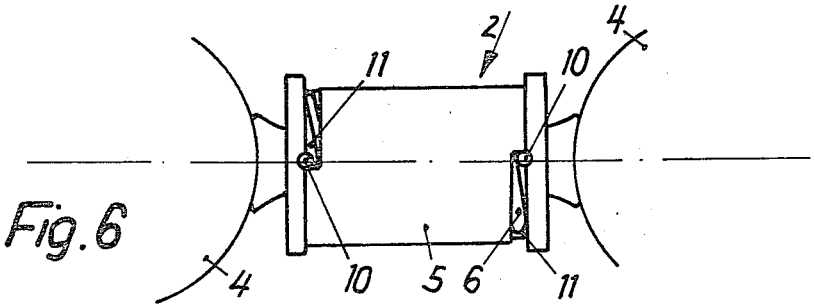

Fig. 7
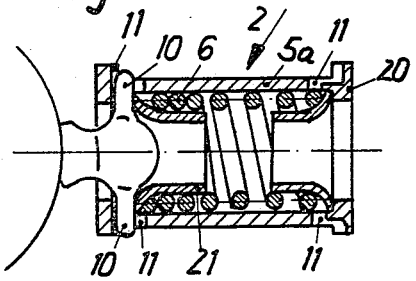
Fig. 8
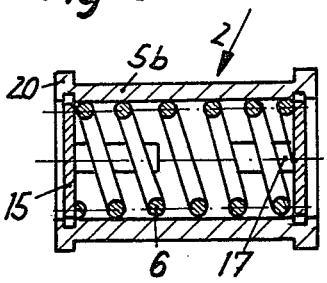
Fig. 9
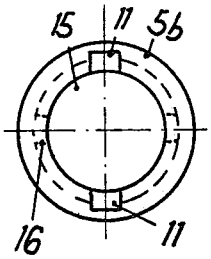
Fig. 12
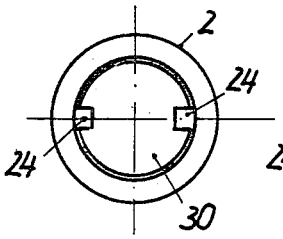
Fig. 10
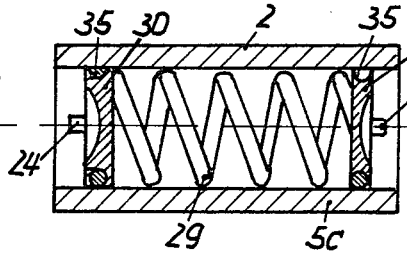
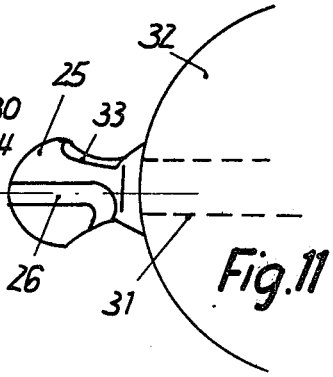
Fig. 11
Fig. 13
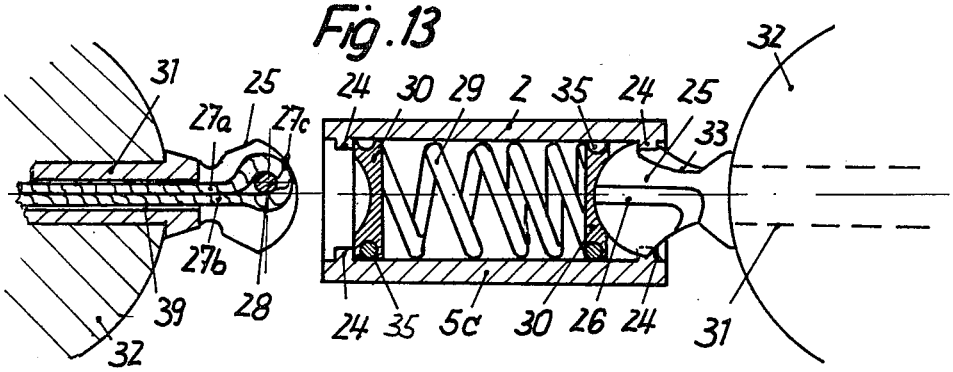
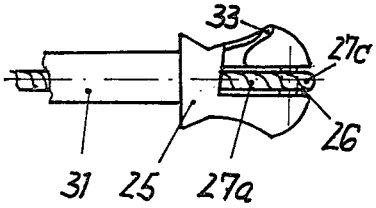
Fig. 14
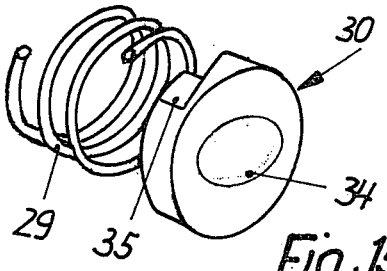
Fig. 15

FLEXIBLE ORNAMENTAL ARTICLE AND FASTENER THEREFOR

This invention relates to a fastener for connecting parts of flexible ornamental article, such as a necklace or bracelet and particularly a string of pearls.

It is an object of the invention to provide a fastener which is adapted to be closed on both sides and serves to connect parts of flexible ornamental article, particularly a string of pearls, and which may serve as a connector for joining flexible ornamental sections to form a flexible ornamental article and to provide flexible ornamental article with a replaceable fastener and also to connect end sections to a main section of a flexible ornamental article which is to be worn in an open state and have parts connected by a fastener which is remote from the ends of the article.

Another object of the invention is to provide a fastener which can be closed at both ends and which can easily be opened and closed and can be closed as well as locked by a single operation.

The fastener according to the invention is characterized in that it comprises a sleeve, which is open at both ends and contains a helical compression spring and is adapted to receive at each of its ends a plug, which is inserted into the sleeve against the force of the helical compression spring and adapted to be rotated in the sleeve to interlock therewith as in a bayonet joint.

Whereas the plugs are firmly connected to different parts of the flexible ornamental article, the sleeve, which is visible when the fastener is closed, can be replaced at any time. By means of the fastener according to the invention, a plurality of flexible ornamental articles can be joined to form a longer flexible ornamental article and e.g., a plurality of bracelets can be joined to form a necklace. Because the fastener comprises a bajonet joint, it can be closed and locked by one and the same operation. Finally, strings or pearls which are to be worn in an open state and have parts connected by a fastener spaced from the ends of the string, may be provided with ornamental end sections, which are joined by means of the fastener according to the invention if such end sections are provided with the same fastener plug.

The sleeve of the fastener may carry an ornament. If the owner of a string of pearls possesses a plurality of such sleeves, which are provided with different ornaments, she can wear one and the same string of pearls together with different ornamental fastners selected to match different dresses or different other ornamental articles.

Each plug of the fastener according to the invention has preferably one or more radial arms, which are adapted to be inserted into indentations in the flanges provided at the ends of the sleeve, and the sleeve is preferably provided behind its flanges with inwardly open radial openings, which are adapted to receive and lock the radial arms of the plug.

The helical spring is preferably held in the sleeve by a crosspin, which extends transversely through the sleeve at the center of the length thereof. In such an arrangement, the ends of the helical spring or the ends of the spring wire which constitutes the helical spring are secured to pistonlike inserts, which are slidable in the sleeve.

In another embodiment of the fastener according to the invention, the helical spring is held in the sleeve by inserts which flare, e.g., in conical shape, near their outer rim and which bear on inturned end rims of the sleeve.

In a third preferred embodiment of the fastener according to the invention, the helical spring is retained in the sleeve by abutment discs, which are guided in grooves formed in the sleeve. The grooves are closed at the open ends of the sleeve so that the abutment discs cannot be forced out of the sleeve by the spring.

In a fastener according to the invention for a string of pearls, each plug has preferably a head, which is provided with radial arms, and a slender cylinder, which extends from said head and is inserted into the last pearl of the string. The plug has in this case an axial through bore, which at the head end of the plug has an enlarged portion for accommodating a knot formed in the thread on which the pearls have been threaded. In this case the pearls are threaded on the thread and the latter is then threaded through the bore in the plug and subsequently formed with a knot, which is subsequently received by the enlarged portion of the bore in the head of the plug.

To close such fastener, the head of the plug is inserted into the sleeve against the force of the helical spring in such a manner that the radial arms extend through the radial indentation of the flange, and the plug is subsequently turned through about 90° until the radial arms have been received and locked in the radial openings of the sleeve.

The fastener is preferably so designed that the plug when inserted in the sleeve is pivotally movable, the arms lying on a common axis which extends diametrically through the sleeve, about the axis of its arms held in holes of the sleeve so that the fastener can adapt itself to the curvatures of the elongated ornamental article.

A particularly satisfactory fixation of a cord on which pearls have been threaded is enabled by a fastener in which each plug consists of a head and a tube, which extends from said head and into the last pearl of the string. Said plug has an axial bore, which receives the thread and extends to an aperture formed in the head and accommodating a crosspiece. The width of the axial bore should be at least twice the diameter of the thread. The thread is formed into a loop around the crosspiece and is returned through the tube and the end of the thread is adhered to the main portion of the cord behind the terminal pearl fitted on the tube.

This fixation of the thread enables a further improvement in the design of the fastener. In a preferred embodiment of the fastener, the helical spring is held by projections, which extend radially into the sleeve and cooperate with recesses in the head of the plug to form a bayonet joint. Axially slidable discs are suitably provided between the ends of the helical spring and the projections of the sleeve and the ends of the helical spring abut on said discs.

The discs may be provided with a hallmark, such as is usual with genuine jewelry. They are suitably formed in their peripheral surface with a helical groove, which receives the adjacent end of the helical spring and prevents the disc from tilting and falling out of the sleeve.

Further advantages and features of the invention will become apparent from the subsequent description of the drawings, in which preferred embodiments of the fastener according to the invention are diagrammatically shown.

FIG. 1 shows the ends of a string of pearls and a fastener according to the invention connecting said ends.

FIG. 2 shows a string of pearls consisting of a plurality of sections joined by a plurality of fasteners according to the invention.

FIG. 3 shows a string of pearls provided with a fastener which carries ornament.

FIG. 4 is a sectional view showing a plug and sleeve of a fastener.

FIG. 5 is an end view showing the sleeve of FIG. 4.

FIG. 6 is an end view of a fastener as shown in FIG. 4.

FIG. 7 is a sectional view showing the sleeve of a fourth embodiment of the fastener.

FIG. 8 is a side elevation showing the head of a plug which has been inserted into a pearl, said head fitting into the sleeve of FIG. 10.

FIG. 9 is an end view showing the sleeve of FIG. 10.

FIG. 10 is a partly sectional view showing the entire fastener of FIGS. 7 to 9 with the sleeve turned 90° from the position shown in FIG. 7.

FIG. 11 is an end view showing the plug which is shown on the left in FIG. 10 and which has been turned 90° from the position shown in FIG. 5.

FIG. 12 is a perspective view showing a disc which is arranged in the sleeve of FIG. 7 and of the associated helical spring.

The drawings show a fastener 2, which has a sleeve 5, 5*a*, 5*b* or 5*c*, to which various pieces of ornament 3 can be soldered. The drawings show also a string of pearls 4 and sections 4′ and 4″ of a string of pearls.

In all embodiments, the fastener 2 comprises a sleeve 5 or 5*a* or 5*b* or 5*c*, which contains a helical spring 6.

In the fastener shown in FIG. 4, the helical spring 6 is retained in the sleeve 5 by a crosspin 7, which extends diametrically through the sleeve at the center of the length of the sleeve 5 and transversely to the axis thereof. The ends of the helical spring 6 are secured to pistonlike inserts 8, which are slidable in the sleeve 5.

The sleeve 5 has two flanges 20, each of which is formed with two diametrically opposite radial indentations 11, or spaced 180° apart, which are continued by slots 11′ which are spaced 90° from the indentations and, which extend in the peripheral direction of the sleeve 5 and terminate in radially inwardly open openings 16. These indentations and slots form part of a bayonet joint.

A plug 9 associated with the sleeve 5 comprises a head, which has two radial arms 10 and is adjoined by a slender cylinder 18. An axial bore 19 extends through the plug throughout the length thereof and has an enlarged portion 12 in the head of the plug or at that end of the head which is opposite to slender cylinder 18. The terminal pearl of the string of pearls 4 has been fitted on the cylinder 18 of the plug. The thread 14 on which the pearls have been threaded has been passed through the axial bore 19 and formed with a knot, which is received in the enlarged portion 13 to retain the thread.

When it is desired to close the string of pearls, the radial arms 10 of the head of the plug 9 are inserted into the indentations 11 and the head of the plug is then pushed into the sleeve 5 against the pressure exerted by the helical spring 6 and is rotated about its axis until the radial arms 10 snap into the openings 16.

FIG. 6 shows a fastener that has been assembled from parts which have been specifically described with reference to FIGS. 4 and 5.

In the fastener 2 shown in FIGS. 10 to 15, the sleeve 5*c* has two mutually opposite, radial projections 24 at each of its two opposite ends. Axially slidable discs 30 are urged against said projections by the pressure exerted by the helical spring 29.

As shown and illustrated in FIGS. 13 and 15, the discs 30 are provided with a rounded surface at the side facing the plugs 25. The head of each plug 25 is also provided with a rounded surface in cooperation with the rounded surface of discs 30.

Each plug 25 comprises a head and a tube 31, which extends from said head and into the last pearl 32 of a string of pearls 4. The axial bore 39 in the tube 31 extends along the axis of the tube and is continued through the head of the plug 25 and terminates in an enlarged portion, in which a crosspiece 28 extends, which is transverse to the axial bore and laterally offset from the same. A thread 27*a* on which the pearls are threaded forms a loop 27*c*, which extends around the crosspiece 28 and back through the axial bore in the tube. The free or terminal end 27*b* of the thread is adhered to the main portion of the thread 27*a* behind the terminal pearl and usually behind the third or fourth pearls, which are spaced from the plug 25.

The head of the plug 25 is formed with two mutually opposite grooves 26, which initially extend in an axial direction and near that end of the head which is adjacent to the tube turn approximately at right angles and terminate in openings 33. These grooves cooperate with the radial projections 24 of the sleeve 5*c* in the manner of a bayonet joint so that the projections 24 slide along the grooves 26 and snap into the openings 33 as the plugs are inserted into the sleeve.

As is apparent from FIG. 12, the discs 30 inserted in the sleeve 5*c* are provided in their peripheral surface with a substantially helical groove 35, which is adapted to recive one end of the helical spring 29. As a result, the discs 30 cannot be tilted in the sleeve and cannot fall out of the same. It is diagrammatically indicated in FIG. 12 that the disc 30 may be provided with a hallmark 34, such as is conventional on genuine jewelry.

What is claimed is:

1. A fastener for connecting two parts of an elongated flexible ornamental article, comprising a sleeve, which is open at both ends and provided with first bayonet joint means adjacent to each end thereof, two plugs, each of which is provided with second bayonet joint means, which are contained in said sleeve and interengage with said first bayonet joint means, a helical compression spring contained in said sleeve between said plugs for urging said plugs axially apart, and two spring abutment discs, which are axially slidable and mounted in said sleeve axially inwardly of said plugs, said discs being engaged by opposite ends of said spring, each of said plugs being rotatable in said sleeve to disengage its second bayonet joint means from the first bayonet joint means and being subsequently axially movable out of said sleeve.

2. A fastener as set forth in claim 1, in which said sleeve carries an ornament.

3. A fastener as set forth in claim 1, in which said first bayonet joint means adjacent to each end of said sleeve comprise a flange formed at the end of said sleeve, said flange formed with at least one radial indentation, the inside peripheral surface of said sleeve being formed with a radially inwardly open opening which is axially inwardly spaced from said indentation, and a slot connecting said indentation and said opening, and said second bayonet joint means of each of said plugs comprises a radial arm, which interlocks with said opening and upon a rotation of said plug in said sleeve is movable in said slot and then axially out of said sleeve through said indentation.

4. A fastener as set forth in claim 1, in which said first bayonet joint means adjacent to each end of said sleeve comprise a radially outwardly extending flange formed with two radial indentations, which are spaced 180° apart, the inside peripheral surface of said sleeve being formed with two radially inwardly open openings, which are spaced 90° from said indentations, and a slot connecting each of said indentations and a respective one of said openings, and in which said second bayonet joint means of each of said plugs comprise two radial arms which interlock with said two openings, and said two openings of each of said first bayonet joint means adjacent to each end of said sleeve and said arms which interlock with said openings lie on a common axis, which extends diametrically through said sleeve, whereby each of said plugs is pivotally movable about said axis.

5. A fastener as set forth in claim 1, in which each of said plugs comprises a head and a tubular stem which is smaller in diameter than said head and extends axially therefrom, each of said plugs is formed with an axial bore, which extends through said tubular stem and head and is open at both ends, and each of said heads is provided with said second bayonet joint means of said plug and at that end which is opposite to said tubular stem is formed with a recess, which merges into said bore, and provided with a crosspiece extending across said recess.

6. A fastener as set forth in claim 5, in which said crosspiece is laterally offset from the axis of said axial bore.

7. A fastener as set forth in claim 1, in which a crosspin extends diametrically through said sleeve at the center of the length thereof and retains said helical spring in said sleeve.

8. A fastener as set forth in claim 1 which comprises pistonlike spring abutments which are axially slidable in said sleeve and engage opposite ends of said spring, and spring-retaining means retaining said spring in said sleeve between said abutments.

9. A fastener as set forth in claim 1, in which each of said plugs comprises a head and a hollow cylindrical stem which is smaller in diameter than said head and extends axially therefrom, and said second bayonet joint means of each of said plugs are carried by said head thereof.

10. A fastener as set forth in claim 9, in which each of said plugs is formed with an axial bore which extends through said stem and head and is open at both ends and has an enlarged portion at that end of said head which is opposite to said stem.

11. A fastener as set forth in claim 1, in which said first bayonet joint means adjacent to each end of said sleeve comprise radially inwardly extending projections provided on the inside peripheral surface of said sleeve said discs being urged against said projections by the pressure of the helical compression spring, and said second bayonet joint means of each of said plugs comprise a head disposed in said sleeve and cooperating with one of said discs and means formed in the outside peripheral surface of said head for engaging said projections.

12. A fastener as set forth in claim 11, in which at least one of said spring abutment discs is provided with a hallmark.

13. A fastener as set forth in claim 11, in which each of said spring abutment discs has a peripheral surface formed with a helical groove and each end of said helical spring extends into the helical groove of the adjacent spring abutment disc.

14. A fastener as set forth in claim 13, in which the side of each of said spring abutment discs facing said plugs comprises a rounded surface, and the head of each of said plugs comprises a rounded surface cooperating with the rounded surface of each of said spring abutment discs.

15. A flexible ornamental article comprising a fastener connecting the ends of said article, which fastener comprises a sleeve which is open at both ends and provided with first bayonet joint means adjacent to each end thereof, two plugs, each of which is connected to one of said parts of said article and provided with second bayonet joint means, which are contained in said sleeve and interengage with one of said first bayonet joint means, a helical compression spring extending in said sleeve between said plugs and urging said plugs axially apart, and two spring abutment discs which are axially slidable and mounted in said sleeve axially inwardly of said plugs, said discs being engaged by opposite ends of said spring, each of said plugs being rotatable in said sleeve to disengage its second bayonet joint means from the first bayonet joint means and being subsequently axially movable out of said sleeve.

16. A flexible ornamental article as set forth on claim 15, in which each of said plugs is connected to one end of said article.

17. A flexible ornamental article as set forth in claim 15, which comprises two flexible ornamental sections, each of which has one end provided with one of said plugs.

18. A flexible ornamental article as set forth in claim 15, in which a thread is threaded through a plurality of ornamental elements, each of said plugs comprises a head and a cylindrical stem, which is smaller in diameter than said head and extends axially therefrom, said second bayonet joint means of each of said plugs are provided on said head thereof, each of said stems extends into one of said ornamental elements.

19. A flexible ornamental article as set forth in claim 18, in which each of said plugs is formed with an axial bore, which extends through said stem and head and is open at both ends and has an enlarged portion at that end of said head which is opposite to said stem, and said thread extends through said axial bore of each of said plugs and comprises two knots, each of which is disposed in one of said enlarged portions.

20. A flexible ornamental article as set forth in claim 15, in which, a thread is threaded through a plurality of ornamental elements, each of said plugs comprises a head and a tube which is smaller in diameter than said head and extends axially therefrom, each of said plugs is formed with an axial bore, which extends through said stem and said tube along the longitudinal axis thereof, and is open at both ends and has a cross-sectional dimension which is twice the diameter of said thread, each of said heads comprises said second bayonet joint means of said plug, a recess disposed at that end of said head which is opposite to said tube and which merges into said bore, and is provided with a crosspiece for securing the thread, each of said tubes extends into one of said ornamental elements, and said thread comprises two loop-shaped end portions, each of which extends through said bore of one of said plugs and around said crosspiece and back through said bore, and at least one of said ornamental elements, and has a terminal end adhered to said thread.

21. A flexible ornamental article as set forth in claim 20, in which said crosspiece is laterally offset from the axis of said axial bore.

* * * * *